US006361105B1

(12) United States Patent
Turner et al.

(10) Patent No.: US 6,361,105 B1
(45) Date of Patent: Mar. 26, 2002

(54) FOLDING CHAIR WITH RETRACTABLE CUP HOLDER

(75) Inventors: Dennis M. Turner, Mooresville, IN (US); Timothy D. Holtke, Green Bay, WI (US); Andrew Mendenhall, Indianapolis, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/762,768

(22) PCT Filed: Aug. 13, 1999

(86) PCT No.: PCT/US99/18460

§ 371 Date: Feb. 13, 2001

§ 102(e) Date: Feb. 13, 2001

(87) PCT Pub. No.: WO00/08978

PCT Pub. Date: Feb. 24, 2000

(51) Int. Cl.[7] ..... A47C 4/00; A47C 7/62

(52) U.S. Cl. ..... 297/23; 297/16.2; 297/55; 297/58; 297/188.14; 297/188.15; 297/188.16

(58) Field of Search ..... 297/16.2, 23, 35, 297/40, 55, 58, 188.14, 188.15, 188.16, 188.17, 188.19

(56) References Cited

U.S. PATENT DOCUMENTS

| | | | | | |
|---|---|---|---|---|---|
| 2,704,114 | A | * | 3/1955 | Williams | 297/188.16 |
| 4,783,037 | A | * | 11/1988 | Flowerday | 297/188.17 X |
| 5,131,716 | A | | 7/1992 | Kwasnik et al. | |
| 5,330,146 | A | * | 7/1994 | Spykerman | 297/188.17 X |
| 5,489,054 | A | * | 2/1996 | Schiff | 297/188.14 X |
| 5,791,616 | A | * | 8/1998 | Volkmann et al. | 297/188.15 X |
| 5,897,089 | A | * | 4/1999 | Lancaster et al. | 297/188.17 X |
| 6,149,238 | A | * | 11/2000 | Tasi | 297/188.14 X |
| 6,209,951 | B1 | * | 4/2001 | Han | 297/188.14 X |

* cited by examiner

*Primary Examiner*—Peter M. Cuomo
*Assistant Examiner*—Rodney B. White
(74) *Attorney, Agent, or Firm*—Barnes & Thornburg

(57) ABSTRACT

A chair includes a chair arm (20) coupled to a frame (22, 28) and a cup holder (24) mounted to chair arm (20) for movement between a retracted position lying underneath chair arm (20) to an opened position lying away from the underside of chair arm (20) to hold a cup (26) therein. Cup holder (24) includes first and second arms (40, 42) mounted for pivotable movement about a pivot axis (44) relative to chair arm (20) and one another. When moved to the opened position, first and second arms (40, 42) cooperate to define a circular cup-receiving opening therebetween. Cup holder (24) also includes an interlock (90) to guide relative movement of first and second arms (40, 42) as those arms are moved between retracted and opened positions.

36 Claims, 8 Drawing Sheets

FOLDING CHAIR WITH RETRACTABLE CUP HOLDER

BACKGROUND AND SUMMARY OF THE INVENTION

The present invention relates to an arm chair and, in particular, an arm chair including a cup holder. More particularly, the present invention relates to a retractable cup holder for a folding chair.

Chairs, especially folding chairs, are frequently placed in groups or set arrangements in both large and small rooms for receptions or other activities. In certain cases, it is inconvenient to place a table next to every chair to provide a place for persons seated in the chairs to place beverage cups or the like.

According to the invention, a chair includes a chair arm coupled to a frame and a cup holder mounted to the chair arm for movement between a retracted position lying underneath the chair arm to an opened position lying away from the underside of the chair arm. A person seated in such a chair can move the cup holder relative to the chair arm to the opened position and place a cup therein whenever the need for such a cup holder arises.

In preferred embodiments, the cup holder includes first and second arms mounted for pivotable movement about a pivot axis relative to the chair arm and to one another. Outer ends of the first and second arms mate with one another and cooperate to define an interlock for guiding relative movement of the first and second arms as those arms are moved by a user between the retracted and opened positions. Each of the first and second arms include a curved serrated edge and these edges cooperate to define a circular cup-receiving opening when the cup holder is moved to its opened position so that a person seated in the chair can place a beverage cup therein.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
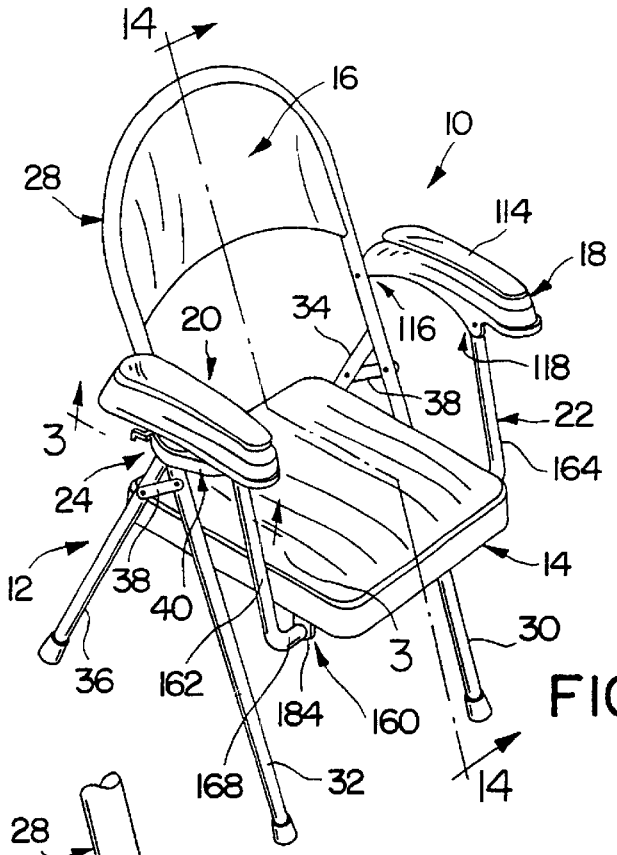
FIGS. 1 is a perspective view of a foldable chair in accordance with the present invention showing a foldable frame, a seat and back mounted on the foldable frame, and right and left arms coupled to the foldable frame and showing a pivotable cup holder in a retraced position underneath the right arm of the foldable chair.

A foldable arm chair is shown in FIG. 1. Chair 10 includes a frame 12, seat 14, back 16, left arm 18, right arm 20, seat-support frame 22, and retractable cup holder 24 mounted to lie in a retracted position underneath right arm 20 as shown, for example, in FIG. 1. It is within the scope of this disclosure to append retractable cup holder 24 to the arm of a non-folding chair (not shown).

Figure 2A:
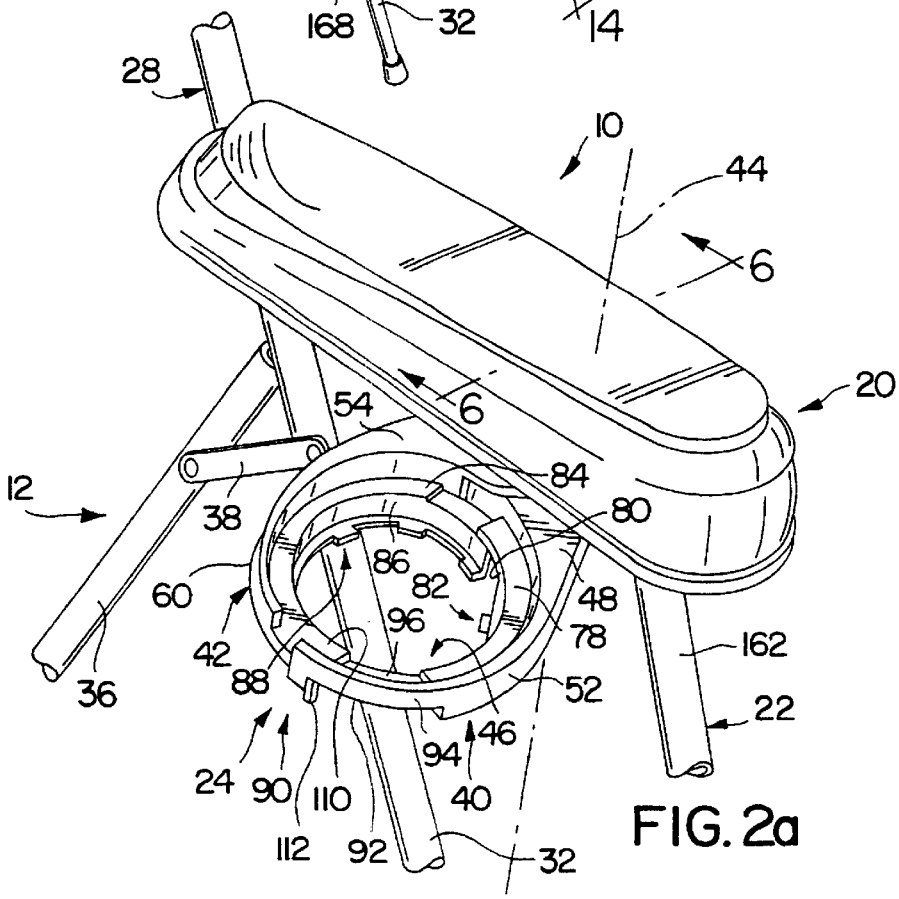
FIG. 2*a* is an enlarged perspective view of a portion of the chair of FIG. 1 showing the position of the cup holder relative to the right arm after a cup-receiving portion of the cup holder has been moved away from the underside of the right arm so that it is ready to receive a cup placed in it by a person seated in the chair.
Figure 5:
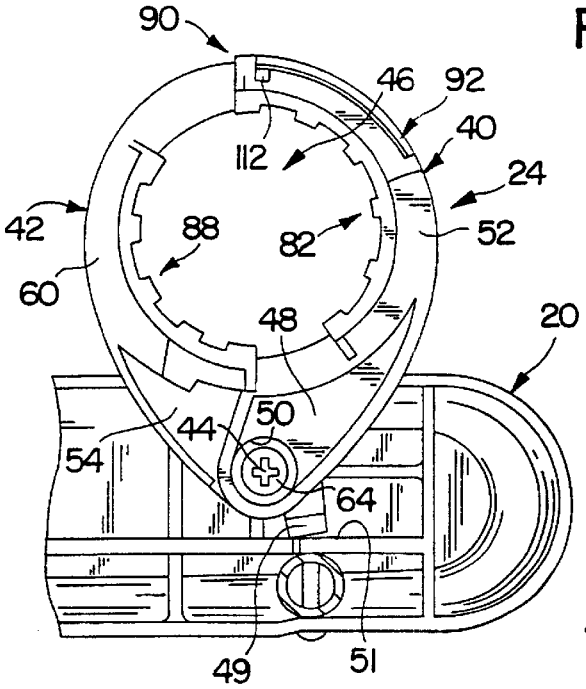
FIG. 5 is a view similar to FIGS. 3 and 4 showing the cup holder in its cup-receiving configuration after pivoting movement of one cup holder arm relative to another cup holder arm to define a somewhat circular cup-receiving opening therebetween.
Figure 6:
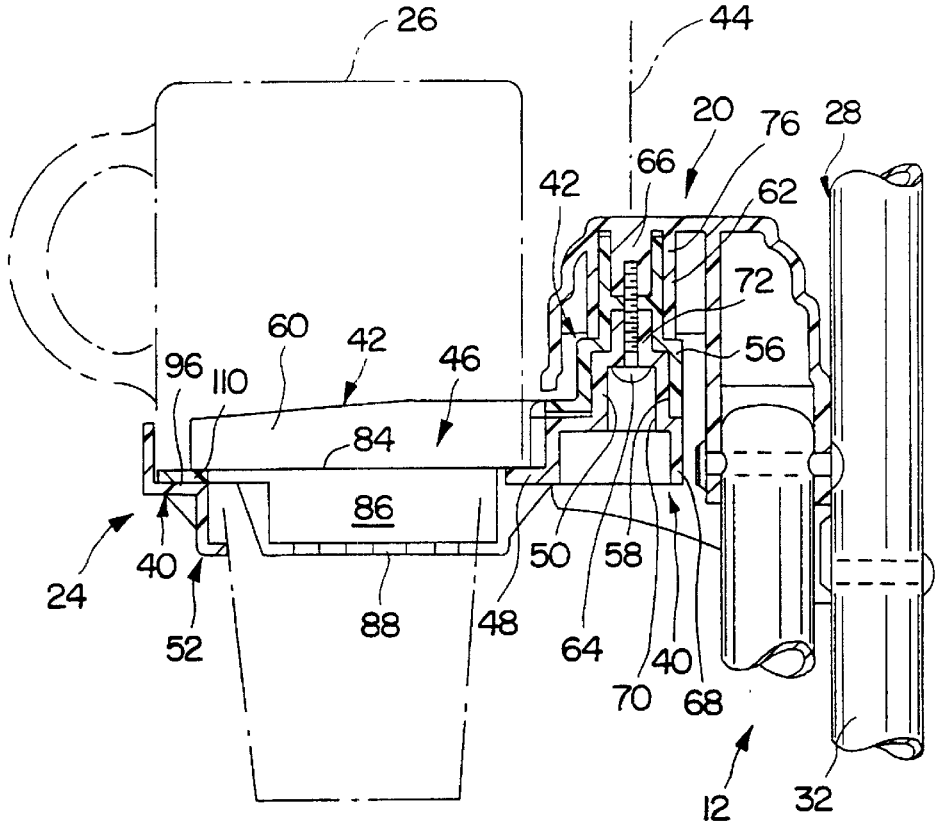
FIG. 6 is a sectional elevational view taken along lines 6—6 of FIG. 2 showing the cup holder in the opened position (also shown in FIG. 5) and showing a phantom cup placed in the cup holder.

Any bystander can move cup holder 24 relative to right arm 20 from the retracted position shown in FIG. 1 to the exposed position shown, for example, in FIG. 2 to enable a person seated in or standing alongside chair 10 to place a cup 26 in cup holder 24 as shown in FIG. 6. Although cup holder 24 is mounted under right arm 20 in the embodiment illustrated in FIGS. 1–6, it is within the scope of this disclosure to mount cup holder in right arm 20, in left arm 22, and/or under left arm 22.

Frame 12 includes a U-shaped tall section 28 carrying back 16 and providing front legs 30, 32 and a pair of rear legs 34, 36. Each of rear legs 34, 36 is pivotably coupled to tall section 28 by pivot links 38 as shown, for example, in FIGS. 1, 2, and 14. Frame 12 can be collapsed manually in a controlled way so that it is folded from the opened position shown in FIGS. 1 and 14 to the collapsed position shown in FIG. 15.

Referring to FIGS. 2–5, cup holder 24 includes a first arm 40 and a second arm 42 that is movable relative to first arm 40 as cup holder 24 moves from its retracted position to its opened position. The first and second arms 40, 42 are coupled to right arm 20 for pivotable movement about a vertical pivot axis 44. Arms 40, 42 cooperate to define a somewhat football-shaped opening upon movement of the arms 40, 42 relative to right arm 20 to the exposed position shown in FIG. 4. Arms 40, 42 cooperate to define a somewhat circular cup-receiving opening 46 upon movement of the arms 40, 42 relative to right arm 20 to the opened position shown in FIGS. 2 and 5.

Figure 2B:
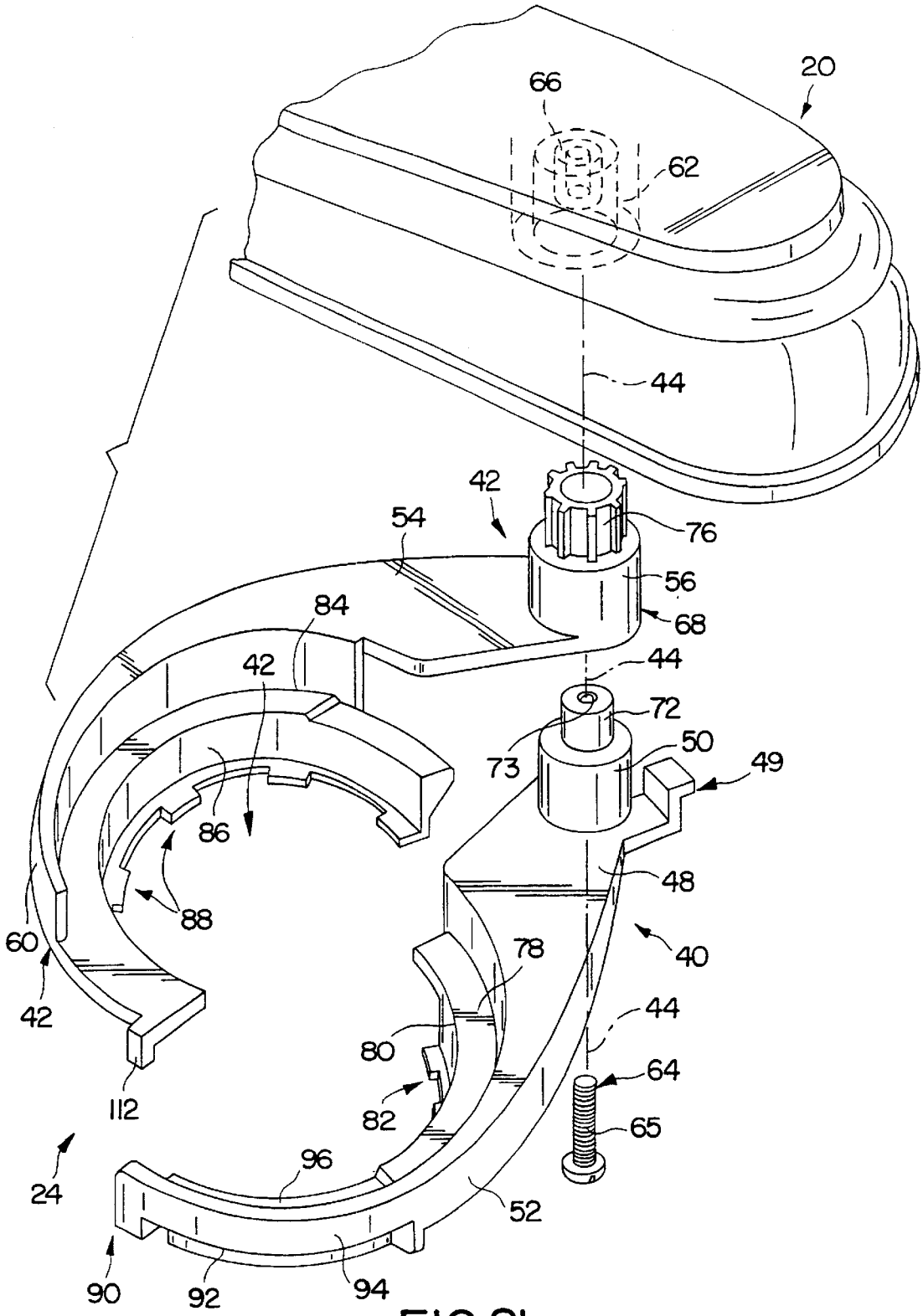
FIG. 2*b* is an enlarged perspective assembly view of first and second arms included in the retractable cup holder below a portion of the right arm of the chair.
Figure 3:
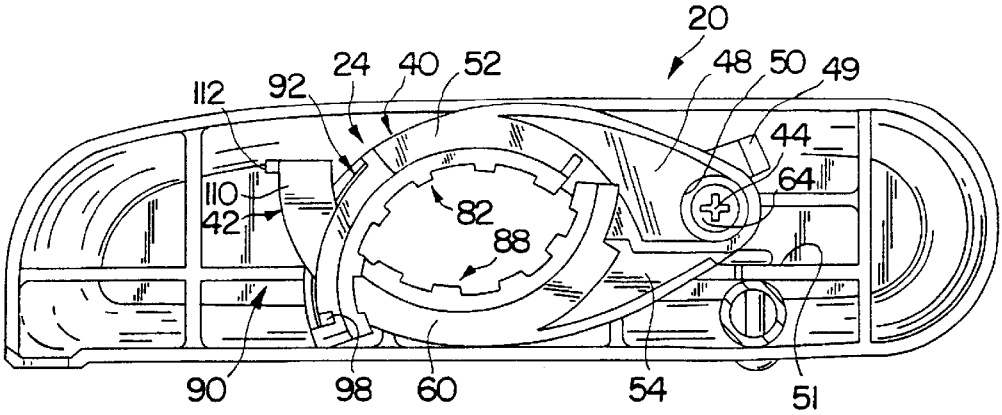
FIG. 3 is a view of the underside of the right arm of the chair taken along line 3—3 of FIG. 1 showing the cup holder in its retracted position underneath the right arm of the chair and showing movement of two pivotable arms of the cup holder toward one another to define a somewhat football-shaped space therebetween to enable the cup holder to be reduced in size so that it fits substantially under the right arm of the chair when it is in its retracted position.

Referring to FIGS. 2*b*, 5, and 6, first arm 40 includes a base 48, a first-arm pivot post 50 appended to base 48, and a first cup support 52 appended to base 48 and configured to define about one-half of the boundary of cup-receiving opening 46. Second arm 42 includes a base 54, a second-arm pivot post 56 appended to base 54 and configured to include a post-receiving channel 58 (for receiving first-arm pivot post 50 therein), and a second cup support 60 appended to base 54 and configured to define the remaining one-half of the boundary of cup-receiving opening 46.

Figure 4:
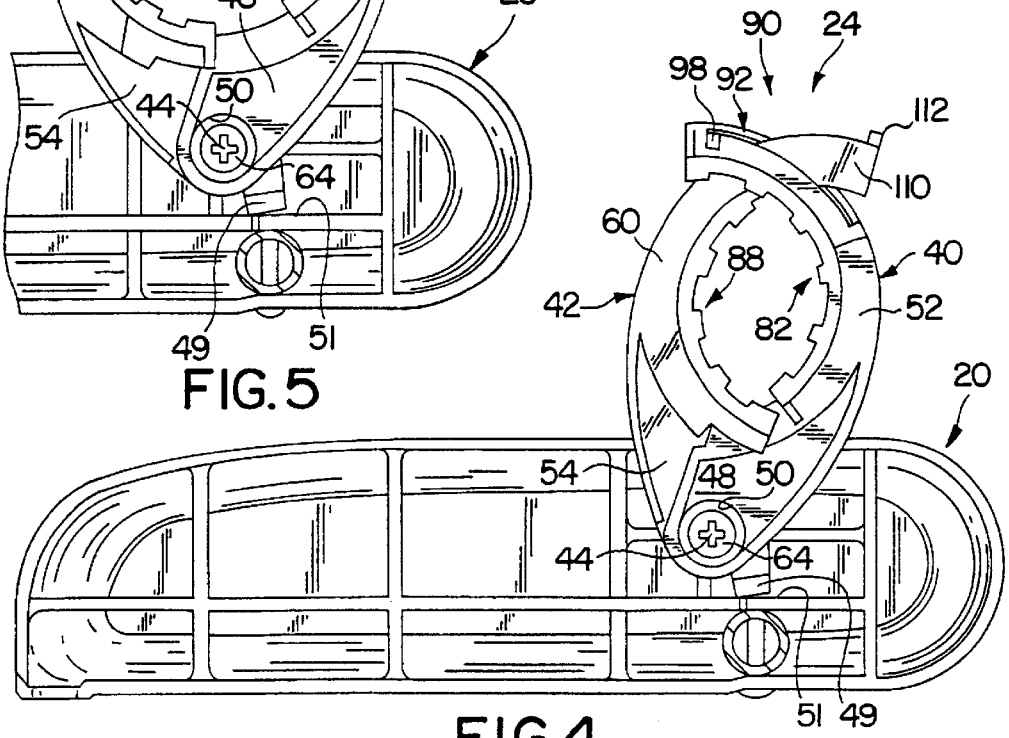
FIG. 4 is a view similar to FIG. 3 showing the position of the cup holder after it has been pivoted from its retracted position to an exposed position but before movement of the cup holder arms away from one another to establish a cup-receiving configuration.

A stop member 49 is appended to base 48 of first arm 40 and arranged to lie adjacent to first-arm pivot post 50 as shown, for example, in FIG. 2*b*. Stop member 49 is arranged to disengage right arm 20 when cup holder 24 lies in its retracted position as shown in FIG. 4. Stop member 49 is arranged to engage a wall 51 in right arm 20 as shown, for example, in FIGS. 4 and 5 to limit pivoting movement of first arm 40 relative to right arm 20 about axis 44 during movement of cup holder 24 to its opened position shown in FIG. 5.

To enable pivoting movement of first and second arms 40, 42 about pivot axis 44 relative to right arm 20 as shown in FIG. 4 and relative to one another as shown in FIG. 4 and relative to one another as shown in FIG. 5, the second-arm pivot post 56 is mounted for rotation about pivot axis 44 in a chamber formed in a post support sleeve 62 formed on the underside of right arm 20, the first-arm pivot post 50 is mounted for rotation in the post-receiving channel 58 formed in second-arm pivot post 56, and a bolt 64 is coupled to a foundation 66 provided in post support sleeve 62 to retain posts 50, 56 in their assembled but rotatable positions relative to right arm 20 as shown in FIG. 6.

First-arm pivot post 50 includes a cylinder-shaped trunk 68 appended to base 48 and formed to include a cavity 70 for receiving the head of bolt 64 as shown, for example, in FIGS. 2*b* and 6. First-arm pivot post 50 further includes a cylinder-shaped branch 72 appended to a distal end of trunk 68 and formed to include a passageway 73 receiving a portion of the shank 65 of bolt 64.

Second-arm pivot post 56 includes a cylinder-shaped trunk 74 appended to base 54 and formed to include the post-receiving channel 58 as shown, for example, in FIGS. 2*b* and 6. Second-arm pivot post 56 further includes a cylinder-shaped branch 76 appended to a distal end of trunk 74 and formed to include a cavity at one end receiving branch 72 of first-arm pivot post 50 therein, a cavity at an opposite end receiving foundation 66 appended to right arm 20 therein, and a partition wall positioned to lie between those two cavities and formed to include an aperture receiving a portion of the shank of bolt 64. As shown in FIG. 6, a tip of the shank of bolt 64 is anchored in a bolt-receiving aperture formed in foundation 66.

First cup support 52 includes a horizontal curved ledge 78, a curved wall 80 depending from ledge 78, and a serrated edge 82 appended to curved wall 80 and arranged to engage a cup placed in cup holder 24 upon movement of cup holder arms 40, 42 to the opened positions shown in FIGS. 2, 5, and 6. Likewise, second cup support 60 includes a horizontal curved ledge 84, a curved wall 86 depending from ledge 84, and a serrated edge 88.

An interlock 90 is provided to control and guide movement of the first and second arms 40, 42 in cup holder 24 during movement of cup holder 24 relative to right arm 20 between, for example, the exposed position shown in FIG. 4 and the opened position shown in FIG. 5. Interlock 90 includes a first portion on first cup support 52 that is arranged to mate with a second portion of interlock 90 on second cup support 60.

Figure 6A:
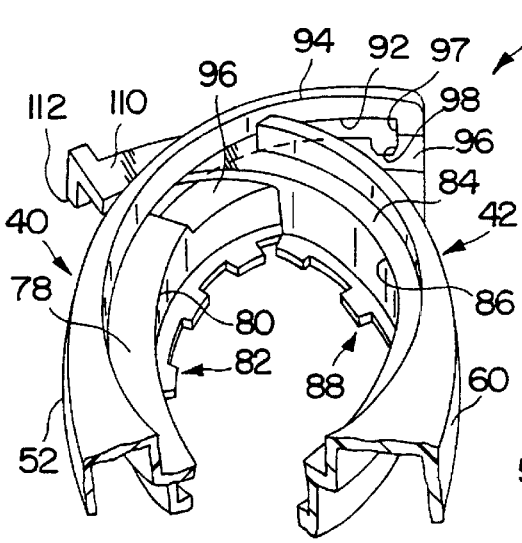
FIG. 6*a* is an enlarged perspective view of a portion, of the cup holder arms looking on the cup holder when it is in the exposed position shown in FIG. 4.
Figure 6B:
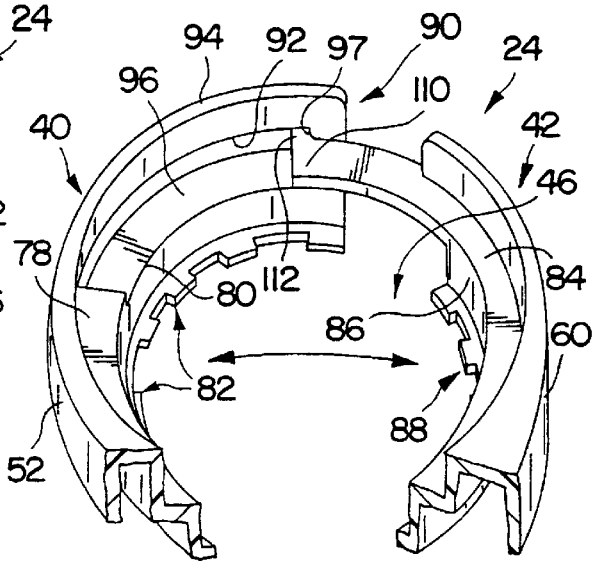
FIG. 6*b* is a view similar to FIG. 6*a* but showing a portion of the cup holder when in the opened position shown in FIG. 5.

The first portion of interlock 90 includes a second-arm slot 92 formed in a curved side wall 94 of first cup support 52 and a horizontal curved guide surface 96 included in first cup support 52 and arranged to border slot 92 as shown, for example, in FIGS. 2*b*, 6*a*, and 6*b*. First cup support 52 further includes a tab stop 97 located at the outer end of first arm 40 and a tab slot 98 formed in curved guide surface 96 to communicate with second-arm slot 92.

The second portion of interlock 90 includes a curved segment 110 at an outer end of second cup support 60 and a radially outwardly projecting, axially downwardly extending tab 112 as shown, for example, in FIGS. 2*b*, 6*a*, and 6*b*. Curved segment 110 is arranged and sized to move back and forth in second-arm slot 92 during movement of second arm 42 relative to first arm 40 as cup holder 24 moves from an exposed position to an opened position as shown in FIGS. 4 and 5. Tab 112 on second arm 42 fits into tab slot 98 formed in first arm 40 to assist in establishing the opened position of the cup holder 24 as shown, for example, in FIGS. 2 and 5. Tab 112 is discharged from tab slot 98 during pivoting movement of first and second arms 40, 42 as cup holder 24 is returned to its retracted position shown in FIG. 3.

Figure 7:
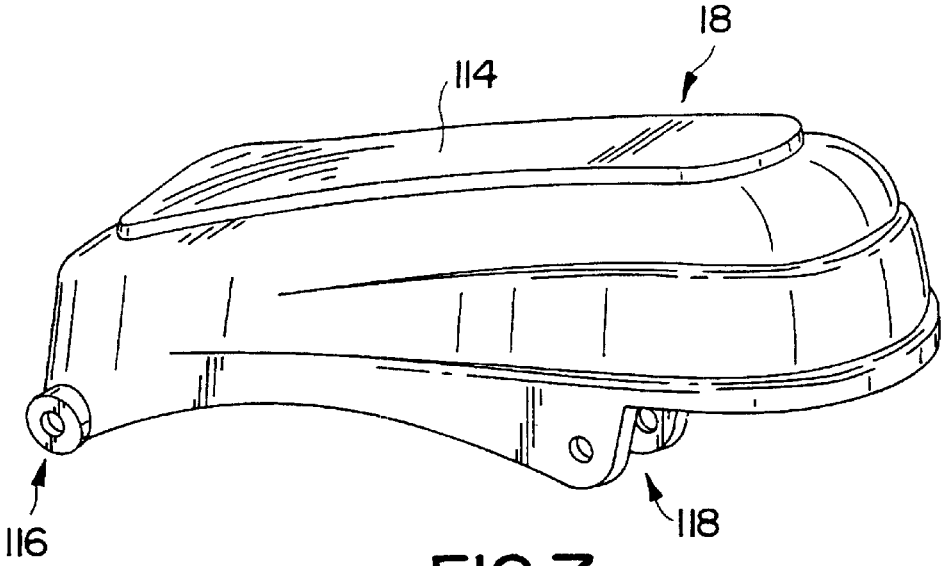
FIG. 7 is an enlarged perspective view of the left arm of the chair of FIG. 1.
Figure 8:
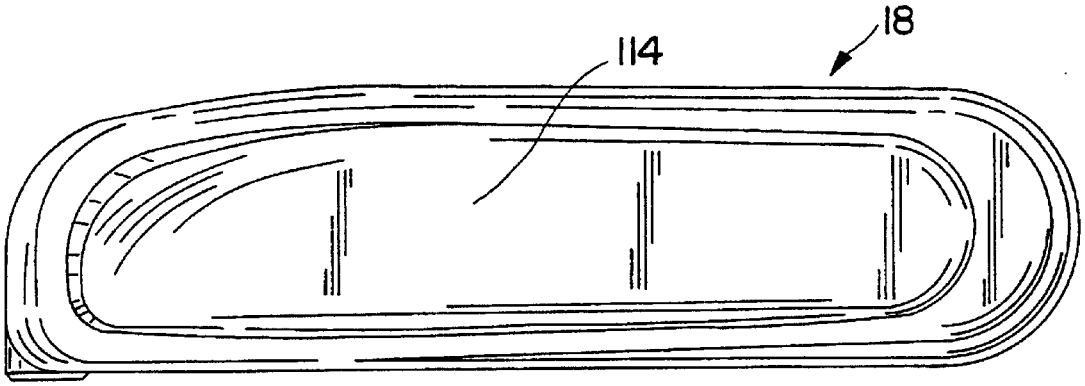
FIG. 8 is a top plan view of the chair arm of FIG. 7.
Figure 9:
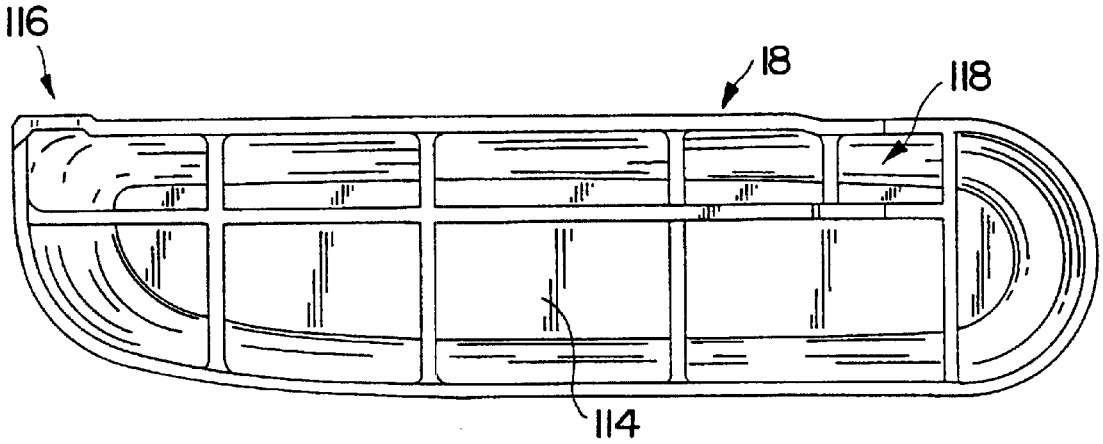
FIG. 9 is a bottom view of the chair arm of FIG. 7.

Several views of left arm 18 of chair 10 are shown in FIGS. 7–9. Left arm 18 includes an armrest 114, a first connector 116 configured to be mounted for pivotable movement to the U-shaped tall section 28 of frame 12, and a second connector 118 configured to be mounted for pivotable movement to seat-support frame 22.

Referring now to FIGS. 10–13, a chair 110 includes a right arm 120, a frame 12, a seat-support frame 22, and a retractable cup holder 124 in accordance with another embodiment of the present invention. Cup holder 124 is coupled to right arm 120 for sliding movement back and forth between a retracted position shown, for example, in FIG. 10 and an opened position shown, for example, in FIG. 11. Chair 110 is similar in all other respects to chair 10.

Figure 10:
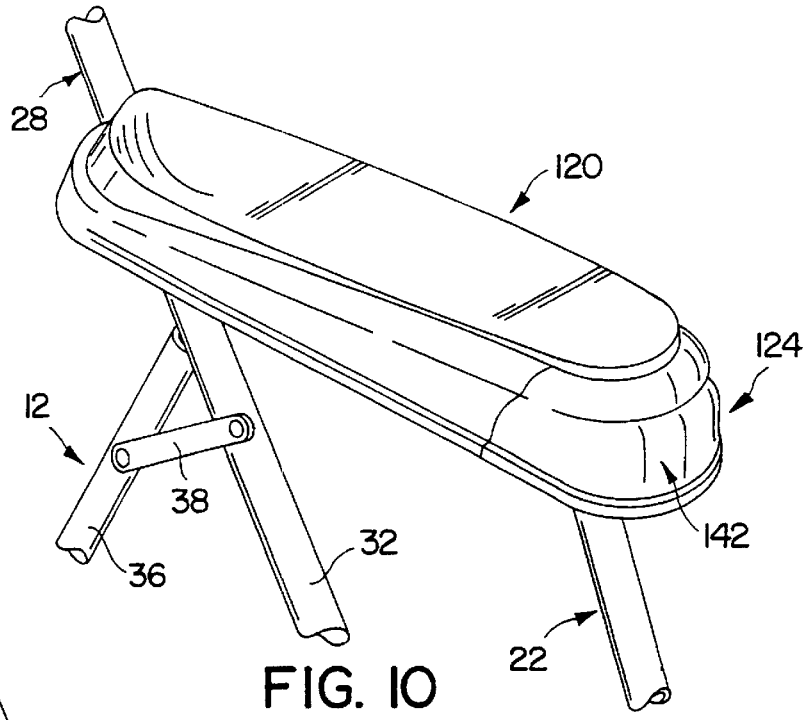
FIG. 10 is a perspective view of a portion of a folding chair similar to the chair illustrated in FIG. 1 showing another embodiment of a cup holder in accordance with the present invention wherein the cup holder is positioned to lie in a retracted position within a space provided in the right arm of the chair.
Figure 12:
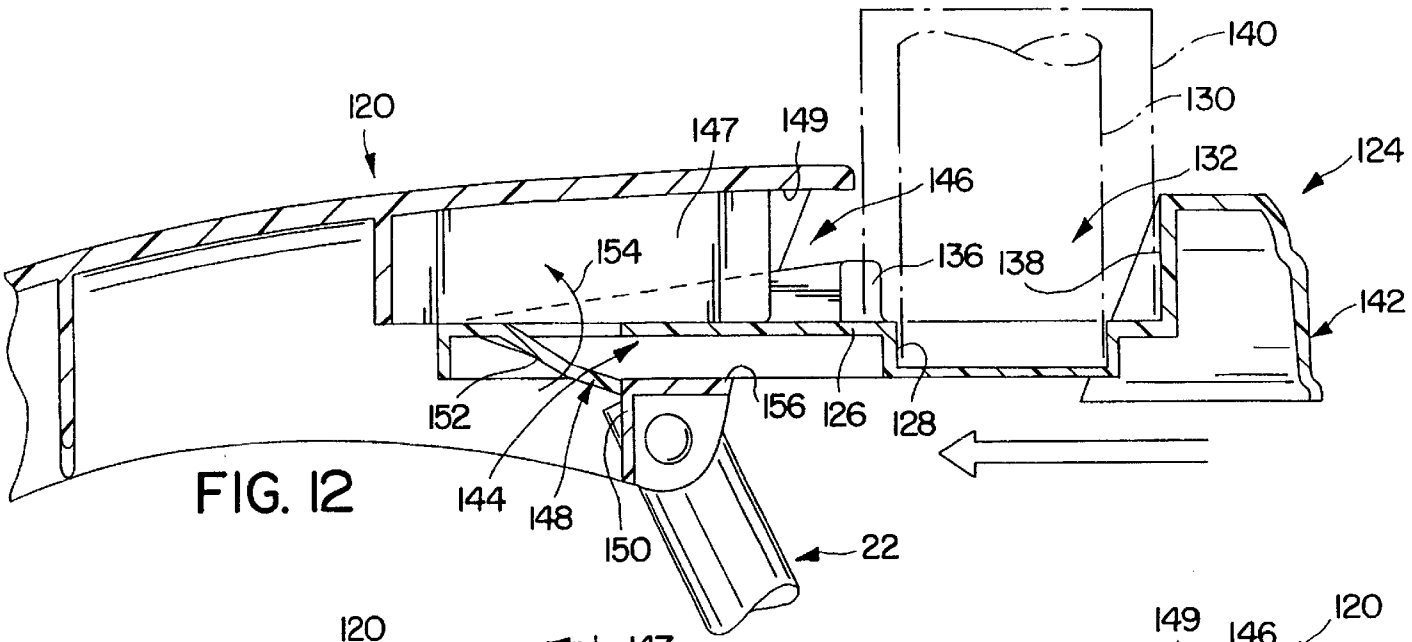
FIG. 12 is a view of a portion of the chair and the chair arm taken along line 12—12 of FIG. 11 showing phantom large-diameter and small-diameter cups placed in the opened cup holder.
Figure 13A:
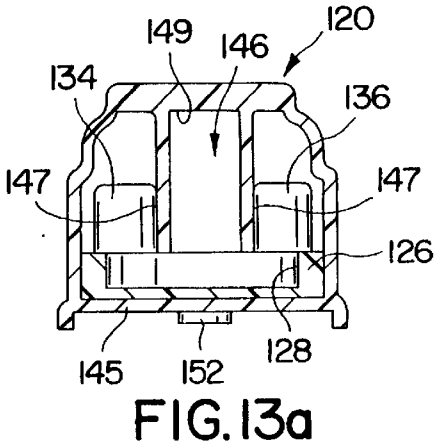
FIG. 13*a* is a transverse sectional view taken along line 13*a*—13*a* of FIG. 13 showing placement of two laterally spaced-apart guides between two rear cup supports provided on a slidable cup holder plate.
Figure 13:
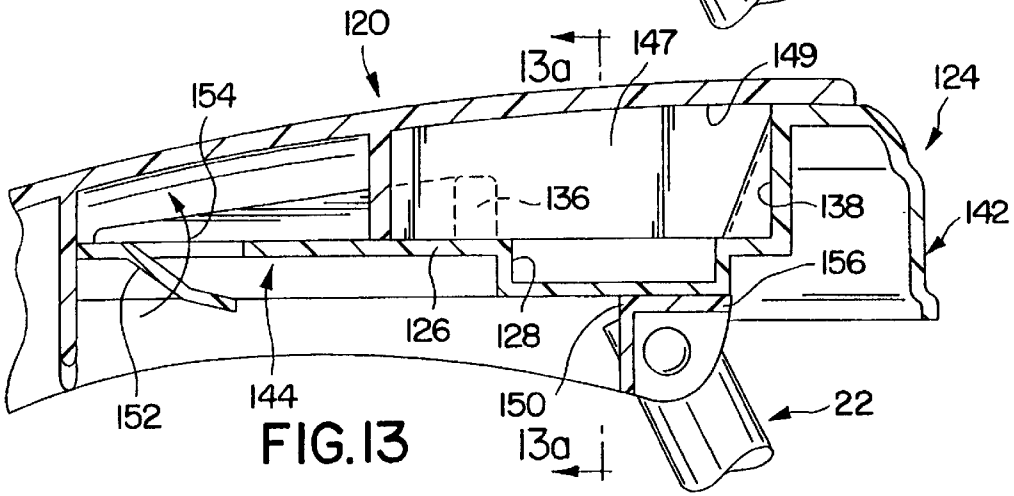
FIG. 13 is a sectional view similar to FIG. 12 showing the cup holder after it has been moved to the left to its retracted position inside the right arm of the chair (as also shown in FIG. 10)

Cup holder 124 includes a plate 126 formed to include a cavity 128 configured to receive a small-diameter base of a cup 130 (shown in phantom) as shown in FIG. 12 and a space 132 bounded, in part, by cup supports 134, 136, and 138 and configured to receive a large-diameter base of a cup 140 (shown in phantom). Cup holder 124 also includes a front end 142 shaped to form a "false front" of right arm 120 when cup holder 124 is moved to its retracted position in right arm 120 as shown in FIGS. 10 and 13. Cup holder 124 further includes a rear end 144 configured to slide on glide plate 145 of right arm 120 in a channel 146 formed in right arm 120. Front end 142 is also formed to include the front cup support 138 and rear end 144 is formed to include rear cup supports 134 and 136.

Figure 11:
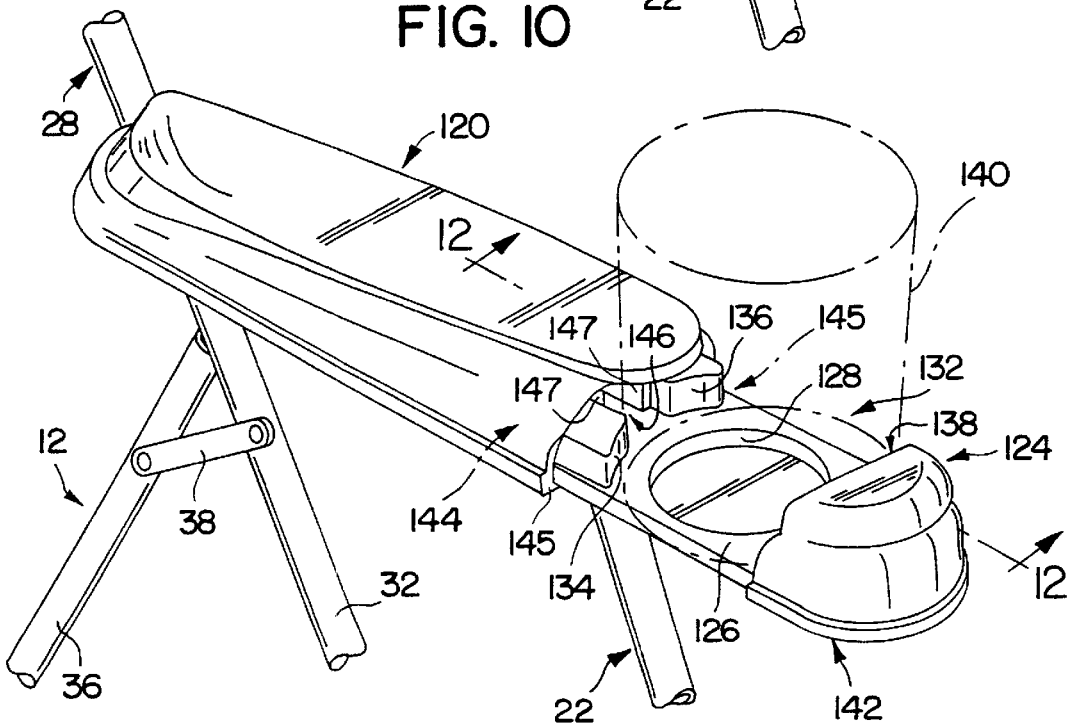
FIG. 11 is a perspective view similar to FIG. 10 showing movement of the cup holder ay from the chair arm to an opened cup-receiving position and showing a phantom large-diameter cup placed in the opened cup holder.

A pair of spaced-apart guides 147 depend from an interior wall 149 in right arm 120 as shown in FIGS. 11–13 to lie in a space provided between rear cup supports 134, 136 on cup holder plate 126. Side walls provided between rear cup supports 134, 136 ride on the guides 147 during movement of cup holder 124 between its retracted and opened positions to guide cup holder 124 so that it moves along a straight line relative to right arm 120.

A flexible tab 148 is appended to rear end 144 of plate 126 and arranged to engage a stop 150 provided on right arm 120 to limit outward sliding movement of cup holder 124 relative to right arm 120 as shown, for example, in FIG. 12. Flexible tab 148 includes cam surface 152 and can be deflected in direction 154 relative to plate 126 upon engagement with edge 156 of right arm 120 during initial installation of cup holder 124 in channel 146 formed in right arm 120.

Figure 14:
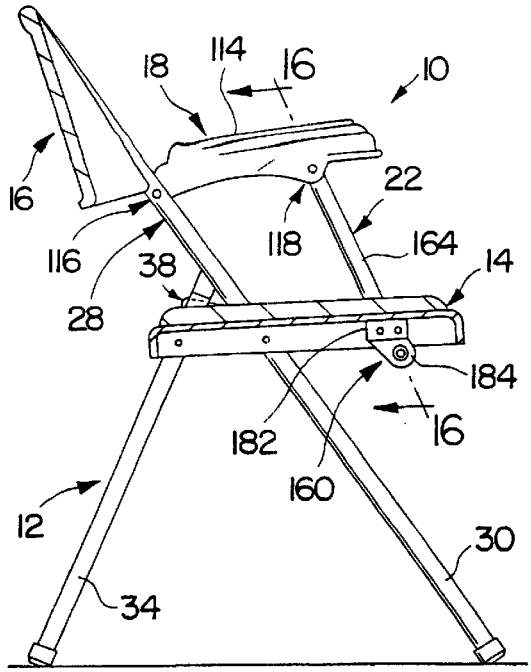
FIG. 14 is a sectional elevational view of the folding chair of FIG. 1 taken along line 14—14 of FIG. 1 showing the left arm and a portion of a U-shaped seat support frame coupled to the left arm and the seat.
Figure 15:
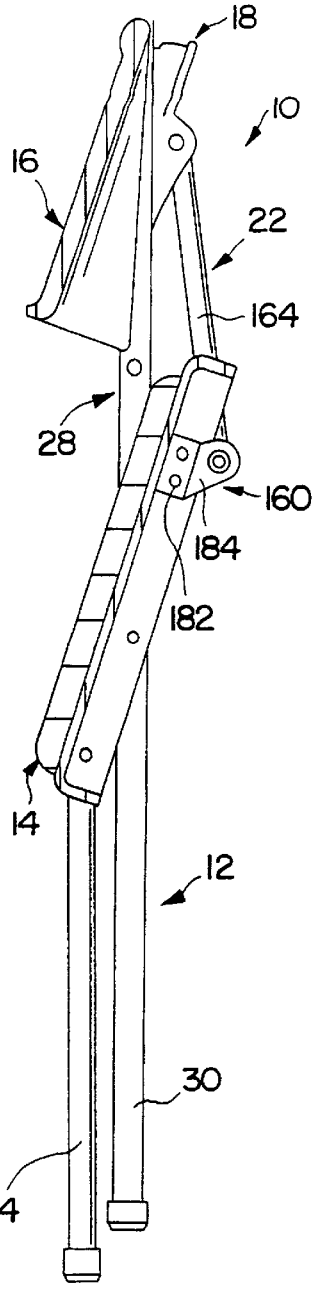
FIG. 15 is an enlarged view of the folding chair of FIG. 14 (still shown in section) after it has been collapsed to its folded position.

Chair 10 (and 110) is able to fold from an opened, use position shown in FIG. 14 to a collapsed, storage position shown in FIG. 15. Such controlled collapse of chair 10, 110 is facilitated in part, by operation of seat-support frame 22 shown in FIGS. 14–17 and frame brackets 160 coupled to seat 14 and seat-support frame 22 as shown, for example, in FIGS. 1, 14–16, and 18.

Figure 16:
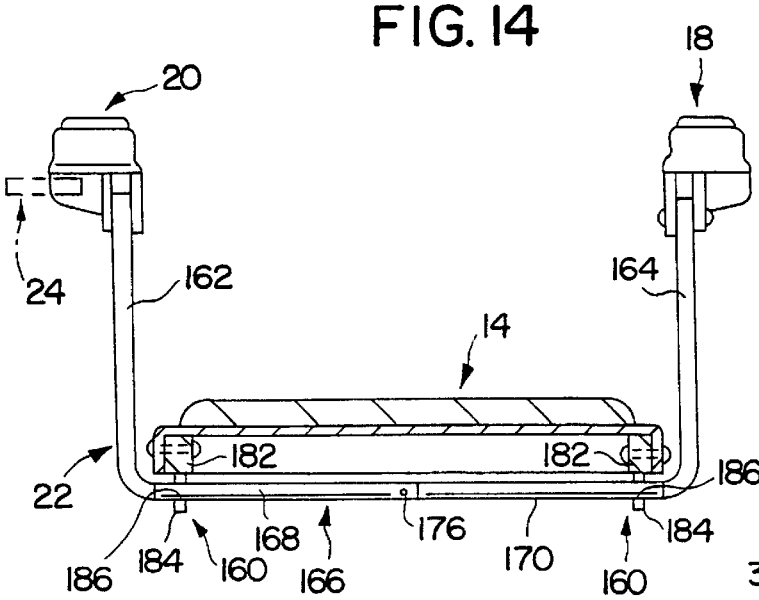
FIG. 16*a* sectional view taken along lines 16—16 of FIG. 14 showing the U-shaped seat-support frame used to couple the seat to the chair arms to enable folding of the chair.

Referring to FIG. 16, seat-support frame 22 is a U-shaped member including a first leg 162 pivotably coupled to right arm 20, a second leg 164 pivotably coupled to left arm 18, and a bight rod 166 interconnecting lower ends of first and second legs 162, 164. Bight rod 166 passes under seat 14 and through frame brackets 160 mounted on the underside of seat 14.

Figure 17:
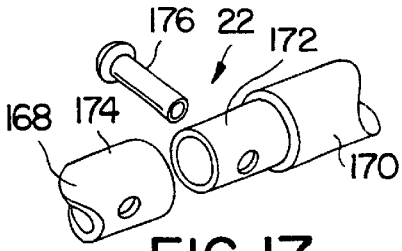
FIG. 17 is an enlarged perspective view of a portion of the U-shaped seat-support frame shown in FIG. 16 showing a system configured to couple one portion of the U-shaped-seat-support frame to another portion thereof.
Figure 18:
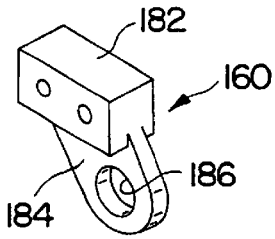
FIG. 18 is a perspective view of a frame bracket coupled to a lower surface of the seat as shown in FIG. 16 to support the U-shaped seat-support frame.

Bight rod 166 includes a first section 168 appended to first leg 162 and a second section 170 appended to second leg 164. As shown in FIG. 17, second section 170 includes an arm 172 that is telescopically received in a sleeve 174 formed in first section 168 and a pin 176 passes through apertures 178, 180 formed in arm 172 and sleeve 174, respectively, to couple first section 168 to second section 170 to establish bight rod 166.

Each frame bracket 160 includes a block 182 coupled to seat 14 and a plate 184 coupled to block 182. Plate 184 is formed to include an aperture 184 sized to receive bight rod 166 of seat-support frame 22 therein and permit rotation of bight rod 166 in aperture 186 as chair 10, 110 moves between its opened and collapsed positions.

Although the invention has been described in detail with reference to certain preferred embodiments, variations and modifications exist within the scope and spirit of the invention as described and defined in the following claims.

What is claimed is:

1. A chair comprising:

a frame, a seat coupled to the frame, a chair arm coupled to the frame and positioned to lie above the seat, and a cup holder mounted to the arm for movement between a retracted position lying underneath the chair arm to an opened position lying away from an underside of the chair arm to hold a cup therein, the cup holder including a first arm and a second arm that is movable relative to the first arm as the cup holder moves from the retracted position to the opened position and the first and second arms cooperate to define a single-cup receiving opening therebetween away from the chair arm upon movement of the first and second arms to the opened position, wherein the first and second arms are coupled to the chair arm for movement about a vertical pivot axis.

2. The chair of claim 1, wherein the first arm includes a first-arm base, a first-arm pivot post appended to the first-arm base and arranged to rotate about the vertical pivot axis, and a first cup support appended to the first-arm base and configured to define about one-half of a boundary of the cup-receiving opening.

3. The chair of claim 2, wherein the second arm includes a second-arm base, a second-arm pivot post appended to the second-arm base and arranged to rotate about the vertical pivot axis, and a second cup support appended to the second-arm base and configured to define a remaining one-half of the boundary of the cup-receiving opening.

4. The chair of claim 1, wherein the chair arm includes a border edge and an interior wall positioned to lie in a region defined by the border edge and the cup holder further includes a stop member coupled to the first arm and arranged to disengage the interior wall upon movement of the cup holder to the retracted position and to engage the interior wall to limit pivoting movement of the first arm relative to the chair arm about the vertical axis during movement of the cup holder to the opened position.

5. The chair of claim 4, wherein the first arm includes a first-arm base, a first-arm pivot post appended to the first-arm base and arranged to rotate about the vertical pivot axis, and a first cup support appended to the first-arm base and configured to define about one-half of a boundary of the cup-receiving opening and the stop member is appended to the first-arm base of the first arm and arranged to lie adjacent to the first-arm pivot post.

6. The chair of claim 1, wherein the chair arm is formed to include a post-receiving chamber having a downwardly facing opening, the second arm includes a second-arm pivot post mounted for rotation about the vertical pivot axis in the post-receiving chamber in the chair arm and formed to include a post-receiving channel, and the first arm includes a first-arm pivot post mounted for rotation about the vertical pivot axis in the post-receiving channel in the second-arm pivot post.

7. The chair of claim 6, wherein the chair further comprises a bolt coupled to a foundation provided in the post-receiving chamber and to the first arm to retain the first-arm and second-arm pivot posts in rotatable positions relative to the chair arm.

8. The chair of claim 7, wherein the first arm further includes a cup support and a first-arm base coupled to the cup support and to the first-arm pivot post, and the first-arm pivot post includes a cylinder-shaped trunk appended to the first-arm base and formed to include a cavity receiving a head included in the bolt and a cylinder-shaped branch appended to a distal end of the cylinder-shaped trunk and formed to include a passageway receiving a portion of a shank included in the bolt.

9. The chair of claim 7, wherein the second arm further includes a cup support and a second-arm base coupled to the cup support and to the second-arm pivot post, and the second-arm pivot post includes a cylinder-shaped trunk appended to the second-arm base and formed to include the post-receiving channel and a cylinder-shaped branch appended to a distal end of the cylinder-shaped trunk and formed to include a cavity at one end receiving a portion of the first-arm pivot post therein, another cavity at an opposite end receiving the foundation therein, and a partition wall positioned to lie between said cavities and formed to include an aperture receiving a portion of the shank of the bolt.

10. The chair of claim 1, wherein the first arm includes a first cup support, the second arm includes a second cup support, and the cup holder further includes an interlock arranged to control and guide movement of the first and second arms relative to one another during movement of the cup holder to the opened position, the interlock including a first portion on the first cup support and a second portion on the second cup support arranged to mate with the first portion on the cup support.

11. The chair of claim 10, wherein the first portion of the interlock includes a second-arm slot formed in a side wall of the first cup support and a horizontal guide surface included in the first cup support and arranged to border the second-arm slot.

12. The chair of claim 11, wherein the fist cup support further includes a tab stop located at an outer end of the first arm and a tab slot formed in the horizontal guide surface to communicate with the second-arm slot.

13. The chair of claim 12, wherein the second portion of the interlock includes a curved segment at an outer end of the second cup support and a radially outwardly projecting, axially downwardly extending tab, the cured segment is arranged and sized to move back and forth in the second-arm slot during movement of the second arm relative to the first arm as the cup holder moves to the opened position, and the tab on the second arm fits into the tab slot formed in the first arm to assist in establishing the opened position of the cup holder.

14. The chair of claim 11, wherein the second portion of the interlock includes a curved segment at an outer end of the second cup support and a radially outwardly projecting, axially downwardly extending tab, the curved segment is arranged and sized to move back and forth in the second-arm slot during movement of the second arm relative to the first arm as the cup holder moves to the opened position.

15. The chair of claim 10, wherein each cup support includes a horizontal curved ledge, a curved wall depending from the horizontal curved ledge, and a serrated edge appended to the curved wall and arranged to engage a cup placed in the cup holder upon movement of the first and second arms to the opened position.

16. The chair of claim 1, wherein each cup support includes a horizontal curved ledge, a curved wall depending from the horizontal curved ledge, and a serrated edge appended to the curved wall and arranged to engage a cup placed in the cup holder upon movement of the first and second arms to the opened position.

17. A chair comprising a frame, a seat coupled to the frame, a chair arm coupled to the frame and positioned to lie above the seat, the chair arm having an underside facing toward the seat, a cup holder including first and second arms, each arm including a first end mounted for pivotable movement about a vertical axis and an opposite second end, the first and second arms being mounted for movement relative to the chair arm wherein one another from a retracted position underneath the underside of the chair arm wherein the first and second arms are positioned to intersect and the second ends of the first and second arms are positioned to lie in spaced-apart relation to one another to an opened position wherein the second ends of the first and second arms are positioned to lie away from the underside of the chair in engagement with one another to cause the first and second arms to cooperate to define a cup-receiving opening therebetween.

18. The chair of claim 17, wherein each of the first and second arms includes an edge adapted to engage a cup placed in the cup-receiving opening and the edges cooperate to define a football-shaped opening when the cup holder lies in the retracted position.

19. The chair of claim 18, wherein the edges of the first and second arms cooperate to define a football-shaped opening therebetween when the cup holder lies in the opened position and the second ends of the first an second arms are positioned to lie in spaced-apart relation to one another and the edges of the first and second arms cooperate to define a circular opening therebetween when the cup holder lies in the opened position and the second ends of the first and second arms are positioned to lie in engagement with one another.

20. The chair of claim 19, wherein the first arm is formed to include a second-arm slot and the second arm includes a segment arranged to lie between the first and second ends of the second arm and slide in the second-arm slot during movement of the second arm relative to the first arm.

21. The chair of claim 18, wherein each edge is serrated.

22. The chair of claim 18, wherein the second ends of the first and second arms are arranged to lie outside the football-shaped opening and under the chair arm when each of the first and second arms lie in the retracted position.

23. The chair of claim 17, wherein the chair arum includes a border edge and an interior wall positioned to lie in a region defined by the border edge and the cup holder flier includes a stop member coupled to the first arm and arranged to disengage the interior wall upon movement of the first and second arms to the retracted position and to engage the interior wall to limit pivoting movement of the first arm relative to the chair arm about the vertical axis during movement of the first and second arms to the opened position.

24. The chair of claim 17, wherein the chair arm is formed to include a post-receiving chamber having a downwardly facing opening, the second arm includes a second-arm pivot post mounted for rotation about the vertical pivot axis in the post-receiving chamber in the chair arm and formed to include a post-receiving channel, and the first arm includes a first-arm pivot post mounted for rotation about the vertical pivot axis in the post-receiving channel in the second-arm pivot post.

25. The chair of claim 17, wherein the chair further comprises a bolt coupled to a foundation provided in the post-receiving chamber and to the first arm to retain the first-arm and second-arm pivot posts in rotatable positions relative to the chair arm.

26. The chair of claim 25, wherein the first arm further includes a cup support and a first-arm base coupled to the cup support and to the first-arm pivot post, and the first-arm pivot post includes a cylinder-shaped trunk appended to the first-arm base and formed to include a cavity receiving a head included in the bolt and a cylinder-shaped branch appended to a distal end of the cylinder-shaped trunk and formed to include a passageway receiving a portion of a shank included in the bolt.

27. The chair of claim 25, wherein the second arm further includes a clip support and a second-arm base coupled to the cup support and to the second-arm pivot post, and the second-arm pivot post includes a cylinder-shaped appended to the second-arm base and formed to include the post-receiving channel and a cylinder-shaped branch appended to a distal end of the cylinder-shaped trunk and formed to include a cavity at one end receiving a portion of the first-arm pivot post therein, another cavity at an opposite end receiving the foundation therein, and a partition wall positioned to lie between said cavities and formed to include an aperture receiving a portion of the shank of the bolt.

28. The chair of claim 17, wherein the first arm includes a first cup support, the second arm includes a second cup support, and the cup holder further includes an interlock arranged to control and guide movement of the first and second arms relative to one another during movement of the cup holder to the opened position, the interlock including a first portion on the first cup support and a second portion on the second cup support arranged to mate with the first portion on the cup support.

29. A chair comprising a frame, a seat coupled to the frame, a chair arm coupled to the frame and positioned to lie above the seat, and a cup holder including a first arm and a second arm movable relative to the first arm to define a cup-receiving opening therebetween, the second arm being coupled to an underside of the chair arm for pivotable movement about a vertical pivot axis relative to the chair a the first arm being coupled to the second arm for pivotable movement about the vertical pivot axis relative to the chair arm and to the second arm.

30. The chair of claim 29, wherein the cup holder further includes an interlock arranged to control and guide movement of the first and second arms relative to one another during pivotable movement of the first and second arms relative to the chair arm and to one another from a retracted position underneath the chair arm to an opened position wherein the cup-receiving opening defined by the first and second arms is positioned to lie away from the underside of the chair arm to receive a cup therein.

31. The chair of claim 30, wherein the interlock includes a first interlock portion on the first arm and a second interlock portion on the second arm and the second interlock portion is arranged to mate with the first interlock portion.

32. The chair of claim 31, wherein the first arm includes a first-arm base, a first-arm pivot post appended to the first-arm base and arranged to rotate about the vertical pivot axis, and a first cup support appended to the first-arm base and configured to define a first portion of the cup-receiving opening and the first interlock portion includes a second-arm slot formed in the first cup support and arranged to receive the second interlock portion therein.

33. The chair of claim 29, wherein the chair arm is formed to include a post-receiving chamber having a downwardly facing opening, the second arm includes a second-arm pivot post mounted for rotation about the vertical pivot axis in the post-receiving chamber in the chair arm and formed to include a post-receiving channel, and the fist arm includes a first-arm pivot post mounted for rotation about the vertical pivot axis in the post-receiving channel in the second-arm pivot post.

34. The chair of claim 33, wherein the chair further comprises a bolt coupled to a foundation provided in the post- receiving chamber and to the first arm to retain the first-arm and second-arm pivot posts in rotatable positions relative to the chair arm.

35. The chair of claim 34, wherein the first arm further includes a cup support and a first-arm base coupled to the cup support and to the first-arm pivot post, and the first-arm pivot post includes a cylinder shaped trunk appended to the first-arm base and formed to include a cavity receiving a head included in the bolt and a cylinder-shaped branch appended to a distal end of the cylinder-shaped trunk and formed to include a passageway receiving a portion of a shank included in the bolt.

36. The chair of claim 34, wherein the second arm further includes a cup support and a second-arm base coupled to the cup support and to the second-arm pivot post, and the second-arm pivot post includes a cylinder-shaped trunk appended to the second-arm base and formed to include the post-receiving channel and a cylinder-shaped branch appended to a distal end of the cylinder-shaped trunk and formed to include a cavity at one end receiving a portion of the first-arm pivot post therein, another cavity at an opposite end receiving the foundation therein, and a partition wall positioned to lie between said cavities and formed to include an aperture receiving a portion of the shank of the bolt.

* * * * *